US011828076B1

(12) United States Patent
Mazzo

(10) Patent No.: US 11,828,076 B1
(45) Date of Patent: Nov. 28, 2023

(54) HYDRAULIC LIFT CAISSON FOR BUILDINGS AND OTHER HEAVY AND/OR LARGE OBJECTS

(71) Applicant: Anthony J Mazzo, New York, NY (US)

(72) Inventor: Anthony J Mazzo, New York, NY (US)

( * ) Notice: Subject to any disclaimer, the term of this patent is extended or adjusted under 35 U.S.C. 154(b) by 0 days.

(21) Appl. No.: 18/204,565

(22) Filed: Jun. 1, 2023

(51) Int. Cl.
*B66F 7/20* (2006.01)
*E04G 23/06* (2006.01)

(52) U.S. Cl.
CPC ..... *E04G 23/065* (2013.01); *B66F 7/20* (2013.01)

(58) Field of Classification Search
CPC ..... B66F 7/00; B66F 7/04; B66F 7/08; B66F 9/00; B66F 9/07559; B66F 11/00; E02D 35/00
See application file for complete search history.

(56) References Cited

U.S. PATENT DOCUMENTS

| | | | | |
|---|---|---|---|---|
| 6,503,024 | B2 * | 1/2003 | Rupiper | E02D 35/00 405/229 |
| 8,458,984 | B2 * | 6/2013 | Marshall | E02D 35/00 52/125.1 |
| 8,573,564 | B2 * | 11/2013 | Rashall | B66F 3/24 254/419 |
| 2008/0175673 | A1 * | 7/2008 | Roberts | E02D 35/00 405/230 |
| 2015/0166313 | A1 * | 6/2015 | Knapp | B66F 11/04 254/89 R |
| 2021/0310265 | A1 * | 10/2021 | Chu | B66F 3/24 |

* cited by examiner

*Primary Examiner* — Lee D Wilson
(74) *Attorney, Agent, or Firm* — Patrick Stanzione; Stanzione & Associates, PLLC

(57) ABSTRACT

A hydraulic lift caisson for buildings including an outer rigid pipe, an inner rigid lifting post and a plurality of threaded lifting rods surrounding the inner rigid lifting post. Also included is a base lifting plate disposed within a bottom end of the outer rigid pipe and connected to a bottom end of the inner rigid lifting post and threaded rods, an anchor plate fixed to a first end of the inner rigid pipe and including a plurality of holes extending therethrough to receive the threaded lifting rods therethrough and a jacking plate disposed above the anchor plate and also including a plurality of holes extending therethrough to receive the threaded lifting rods therethrough, and at least one hydraulic jack disposed between the anchor plate and a jacking plate to lift the jacking plate, lifting post and building.

11 Claims, 8 Drawing Sheets

HYDRAULIC LIFT CAISSON FOR BUILDINGS AND OTHER HEAVY AND/OR LARGE OBJECTS

STATEMENT REGARDING FEDERALLY SPONSORED RESEARCH OR DEVELOPMENT

Not applicable.

COPYRIGHT NOTICE

A portion of this disclosure contains material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever. 37 C.F.R 1.71(d).

BACKGROUND OF THE INVENTIVE CONCEPT

1. Field of the Invention

The present inventive concept relates to a hydraulic lift caisson to lift buildings and other large and/or heavy objects. More particularly, but not exclusively, this inventive concept relates to a hydraulic lift caisson to lift buildings off the ground or off a cellar floor to extreme heights in one continuous stroke.

Description of the Related Art

Buildings are sometimes required to be moved from one location to another, or may be required to be raised due to an unstable foundation which needs to be reinforced. In these cases the building being required to be moved must first be raised off the ground before being able to be moved. However, raising and moving a building is a very complex task with great risks to the building's structure, including unrepairable damage, if not performed properly.

Conventionally raising a building has been performed with a significant number of hand jacks and manpower to raise the building in slight increments at a time. Even with this process the building often ends up being raised unevenly, causing cracks or more significant damage to the foundation of the building and to the building itself. Once a foundation of a building is damaged repairs to this foundation are extremely difficult and often impossible to achieve. Similarly, once a building's structure becomes damaged repairs to the building are extremely difficult and often impossible to achieve.

U.S. Pat. No. 9,022,355 by Pigeon is directed to a hydraulic jack attachment for quickly and safely jacking up high clearance objects. The hydraulic jack attachment includes a base support 20, a footing 30, and a linkage tube 40 interlocked with a lifting member 50 and positioned within the base support 20. A hydraulic jack 12 can be placed into a lower end 22 of the base support 20 via an access opening 23. When the jack 12 is lifted, it will force the linkage tube 40 and lifting tube 50 upwards. A lifting head 60 on the upper end 51 of the tube 50 will press against and force an object upward. This hydraulic jack attachment is not configured to lift heavy objects, such as a building, cannot provide the stability required to lift a building, and cannot be provided in plurality while simultaneously controlling each of the plurality of hydraulic jack attachments to lift such heavy objects evenly.

KR 20090006548A by Son slang HYEOK is directed to a structure lifting device to lift a structure to the appointed height without dismantling the structure, and to regulate the lifting height of a structure easily by fixing, using a locking nut, after lifting up to the appointed height. This structure lifting device comprises a plurality of support columns 100 composed of a circular steel pipe fixed to the ground, a plurality of full thread bolts 200 inserted within the support column 100 and installed to make each end exposed to the upper part, and an end plate 300 provided with a plurality of through holes on its corners to penetrate the full thread bolts and attached to the top of the support column, and a hydraulic jack 400. This lifting device cannot lift heavy loads to great heights because it relies solely on the structural strength and stability of the plurality of the threaded rods, which are relatively slender and, thus, are not suitable to support heavy loads in compression. Also, this lifting device does not have the structural reliability to maintain a constant lifting capacity because the load carrying capacity and stability of the plurality of threaded rods in compression inherently decreases as the height of the lift increases.

Accordingly, there is a need for a lift caisson that can lift heavy buildings.

There is also a need for a lift caisson that can lift heavy buildings evenly to prevent damage to foundations and building structures to unlimited heights.

There is also a need for a lift caisson that can lift a heavy building from its foundation or from the ground.

SUMMARY OF THE INVENTIVE CONCEPT

The present general inventive concept provides a hydraulic lift caisson to lift buildings (or other large and/or heavy objects). More particularly, but not exclusively, this inventive concept relates to a hydraulic lift caisson to lift buildings off the ground or cellar floor in one continuous stroke.

Additional features and utilities of the present general inventive concept will be set forth in part in the description which follows and, in part, will be obvious from the description, or may be learned by practice of the general inventive concept.

The foregoing and/or other features and utilities of the present general inventive concept may be achieved by providing a hydraulic lift caisson to lift a building, comprising: a rigid pipe at least 10 feet in length having first and second ends; a rigid lifting post at least 10 feet in length disposed within the rigid pipe and including first and second ends; a base lifting plate having a diameter substantially the same as an inner diameter of the rigid pipe, the base lifting plate being attached to the second end of the rigid lifting post and including a plurality of symmetrical holes therethrough surrounding the rigid lifting post and configured to move along the length of the inner diameter of the rigid pipe; an anchor plate fixed to the first end of the rigid pipe and including a center cutout to receive the rigid lifting post therethrough and a plurality of symmetrical holes surrounding the cutout; a jacking plate disposed directly above the anchor plate and including a center cutout to receive the rigid lifting post therethrough and a plurality of symmetrical holes surrounding the cutout; a plurality of threaded lifting rods extending through respective ones of the holes through the base lifting plate, the anchor plate and the jacking plate, each of the threaded lifting rods including a base plate locking nut threaded onto a bottom end of each of the threaded rods to lock the bottom end of the threaded rods to the base lifting plate, an anchor plate locking nut threaded onto each of the threaded lifting rods directly above the anchor plate to cause the threaded lifting rods to hang from the anchor plate, and a jacking plate full load nut threaded to each of the threaded lifting rods to rest on a top surface of the jacking plate; and a plurality of hydraulic jacks disposed between the anchor plate and the jacking plate to lift the jacking plate away from the anchor plate, thus also lifting the threaded lift rods, base lifting plate and rigid lifting post upward together with the jacking plate.

In an exemplary embodiment, the rigid pipe, the rigid lifting post, the threaded rods, the anchor plate and the jacking plate are formed of steel.

In another exemplary embodiment, the rigid lifting post is square and the plurality of threaded lifting rods are twelve in number, wherein three threaded lifting rods are disposed adjacent to each of the four sides of the rigid lifting post.

In another exemplary embodiment, the anchor plate and the jacking plate are square and the plurality of hydraulic jacks include one hydraulic jack disposed at each corner of the anchor plate and jacking plate.

In still another exemplary embodiment, the rigid pipe is thirty-six inches in diameter and has a ½ inch thick wall.

In yet another exemplary embodiment, the rigid lifting post includes four sixteen inch sides that are each ⅝ inch thick.

In still another exemplary embodiment, the anchor plate and the jacking plate are four inches thick.

The foregoing and/or other features and utilities of the present general inventive concept may also be achieved by providing a hydraulic lift caisson to lift large heavy objects, comprising: a circular rigid pipe having first and second ends; a rigid lifting post disposed within the rigid circular pipe and including a first end extending out of the first end of the circular rigid pipe and a second end; a circular base lifting plate having a diameter substantially the same as an inner diameter of the rigid pipe, the base lifting plate being attached to the second end of the rigid lifting post and configured to move along a length of the inner diameter of the rigid circular pipe; an anchor plate fixed to the first end of the rigid circular pipe and including a center cutout to receive the rigid lifting post therethrough and a plurality of symmetrical holes surrounding the cutout; a jacking plate disposed directly above the anchor plate and including a center cutout to receive the rigid lifting post therethrough and a plurality of symmetrical holes surrounding the cutout; a plurality of threaded lifting rods each having a first end extending through respective holes in the anchor plate and jacking plate and having a second end connected to the base lifting plate, each of the threaded lifting rods including an anchor plate locking nut threaded onto the first end thereof to be disposed directly above the anchor plate to cause the threaded lifting rods to hang from the anchor plate and a jacking plate full load nut threaded onto the first end thereof to rest on a top surface of the jacking plate; and at least one hydraulic jack disposed between the anchor plate and the jacking plate to lift the jacking plate away from the anchor plate, thus also lifting the threaded lift rods, the base lifting plate and the rigid lifting post upward together with the jacking plate.

In an exemplary embodiment, the circular rigid pipe and the rigid lifting post are formed in ten feet increments and can be attached to another one of the circular rigid pipes and rigid lifting posts, respectively, to form a single twenty foot circular rigid pipe and a single twenty foot lifting post.

BRIEF DESCRIPTION OF THE DRAWINGS

These and/or other features and utilities of the present inventive concept will become apparent and more readily appreciated from the following description of the embodiments, taken in conjunction with the accompanying drawings of which.

Figure 1:
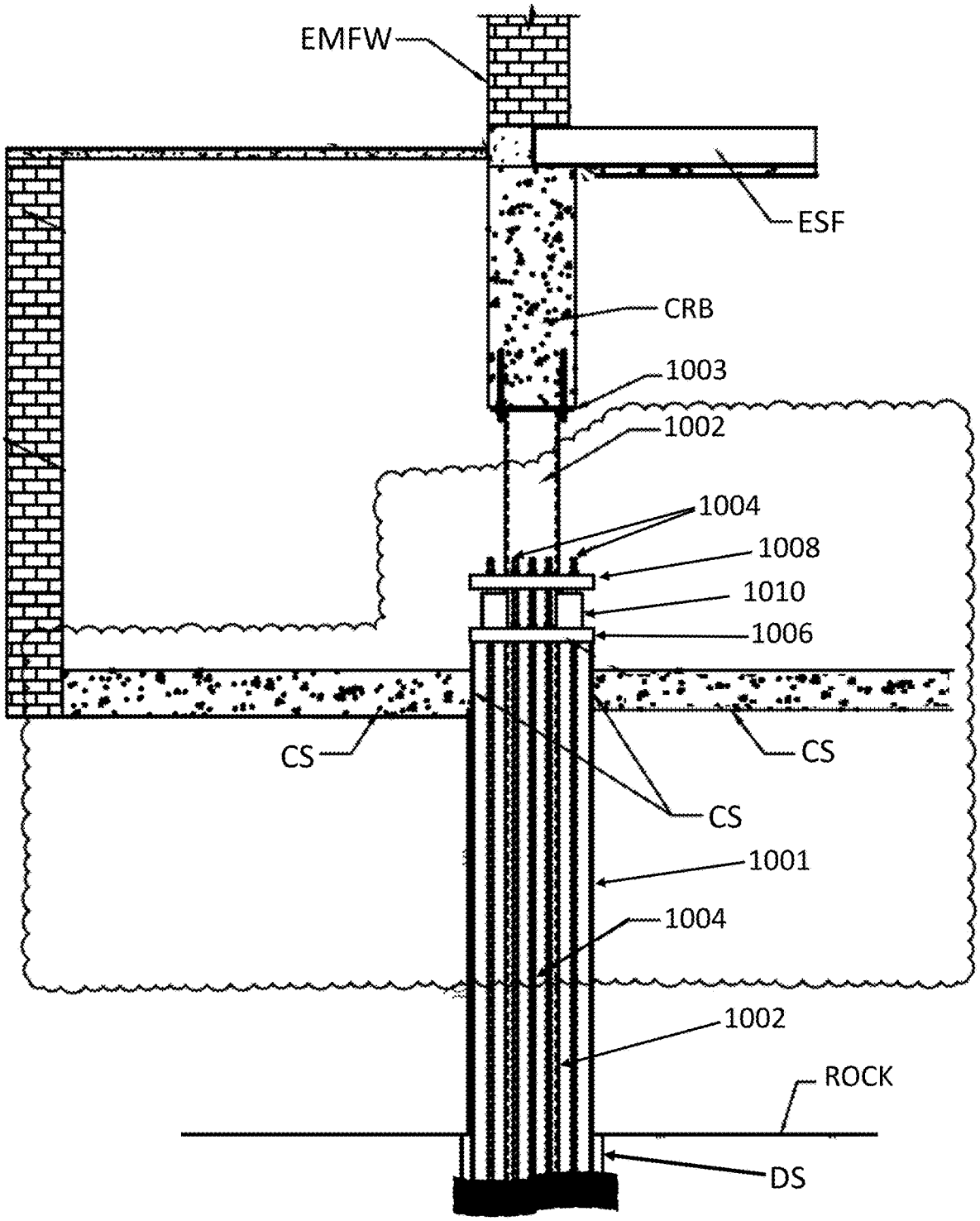
FIG. 1 illustrates a plan view of a hydraulic lift caisson according to an example embodiment of the present inventive concept.

The drawings illustrate a few exemplary embodiments of the present inventive concept, and are not to be considered limiting in its scope, as the overall inventive concept may admit to other equally effective embodiments. The elements and features shown in the drawings are to scale and attempt to clearly illustrate the principles of exemplary embodiments of the present inventive concept. In the drawings, reference numerals designate like or corresponding, but not necessarily identical, elements throughout the several views.

DETAILED DESCRIPTION OF THE PREFERRED EMBODIMENTS

Reference will now be made in detail to the embodiments of the present general inventive concept, examples of which are illustrated in the accompanying drawings, wherein like reference numerals refer to the like elements throughout. The embodiments are described below in order to explain the present general inventive concept while referring to the figures. Also, while describing the present general inventive concept, detailed descriptions about related well-known functions or configurations that may diminish the clarity of the points of the present general inventive concept are omitted.

It will be understood that although the terms "first" and "second" are used herein to describe various elements, these elements should not be limited by these terms. These terms are only used to distinguish one element from another element. Thus, a first element could be termed a second element, and similarly, a second element may be termed a first element without departing from the teachings of this disclosure.

Expressions such as "at least one of," when preceding a list of elements, modify the entire list of elements and do not modify the individual elements of the list.

All terms including descriptive or technical terms which are used herein should be construed as having meanings that are obvious to one of ordinary skill in the art. However, the terms may have different meanings according to an intention of one of ordinary skill in the art, case precedents, or the appearance of new technologies. Also, some terms may be arbitrarily selected by the applicant, and in this case, the meaning of the selected terms will be described in detail in the detailed description of the invention. Thus, the terms used herein must be defined based on the meaning of the terms together with the description throughout the specification.

Also, when a part "includes" or "comprises" an element, unless there is a particular description contrary thereto, the part can further include other elements, not excluding the other elements.

Hereinafter, one or more exemplary embodiments of the present general inventive concept will be described in detail with reference to accompanying drawings.

Exemplary embodiments of the present general inventive concept are directed to a hydraulic lift caisson to lift buildings (or other large and/or heavy objects). More particularly, but not exclusively, this inventive concept relates to a hydraulic lift caisson to lift buildings off the ground or a cellar floor in which such buildings are built on. The exemplary embodiments will be described in detail below with reference to FIG. 1 through FIG. 6.

FIG. 1 illustrates a plan view of a hydraulic lift caisson 1000 according to an exemplary embodiment of the present inventive concept. Referring to FIG. 1, a hydraulic lift caisson 1000 can include an outer pipe 1001 as a main body. The outer pipe 1001 can be formed of steel, or any other metal material that will withstand tons of weight. For consistency the outer pipe 1001 will be referred to as an outer steel pipe 1001. The outer steel pipe 1001 is preferably 36 inches in diameter and can have a wall thickness of ½ inch. The outer steel pipe 1001 can be provided in 10 feet sections or can be formed as one single piece to a desired length. The desired length of the outer steel pipe 1001 will depend on how deep the requirement will be to insert the outer steel pipe 1001 into the ground in order to rest a bottom end thereof securely on solid rock underground while a top end thereof extends up past the ground level in which a building rests. Alternatively, the outer steel pipe 1001 can have a different diameter and wall thickness depending on the size and weight of a building intended to be lifted. A plurality of outer steel pipes 1001 can be connected together to provide one elongated outer steel pipe 1001, as will be described in more detail below.

Within the outer steel pipe 1001 can be provided a steel lifting post 1002. The steel lifting post 1002 preferably extends the entire length of the outer steel pipe 1001 and is preferably formed to be 16 inches by 16 inches square, with a wall thickness of ⅝ inch. The steel lifting post 1002 can be provided in 10 feet sections or can be formed as one single piece to a desired length. The desired length of the steel lifting post 1002 will depend on how deep the requirement will be to insert the steel lifting post 1002, within the outer steel pipe 1001, into the ground in order to rest the bottom end of the outer steel pipe 1001 securely on solid rock underground while a top end extends up past the ground level in which a building rests. A plurality of steel lifting posts 1002 can be connected together to provide one elongated steel lifting post 1002, as will be described in more detail below. Alternatively, the steel lifting post 1002 can have a different area and wall thickness depending on the size and weight of a building to be lifted. Also, the steel lifting post 1002 can be formed of alternative types of metals which will withstand several tons of weight. The steel lifting post 1002 is preferably disposed to extend along the inner center of the outer steel pipe 1001. The steel lifting post 1002 preferably includes a top lifting plate 1003 formed at a first (top) end thereof, which is configured to extend out through the first (top) end of the outer steel pipe 1001 when the hydraulic lift caisson 1000 is in operation, as will be described in more detail below.

The outer steel pipe 1001 can also include a plurality of threaded lifting rods 1004 disposed therein and extending along the entire length therein. The threaded lifting rods 1004 are preferably disposed to surround the steel lifting post 1002 and are preferably also formed of steel. The threaded lifting rods 1004 can alternatively be formed of another type of metal which will withstand the weight of several tons. According to an example embodiment, the plurality of threaded lifting rods 1004 can include twelve threaded lifting rods 1004. Alternatively, the threaded lifting rods 1004 can be provided in a certain number depending on the size and weight of a building to be lifted by the hydraulic lift system 1000.

Figure 4:
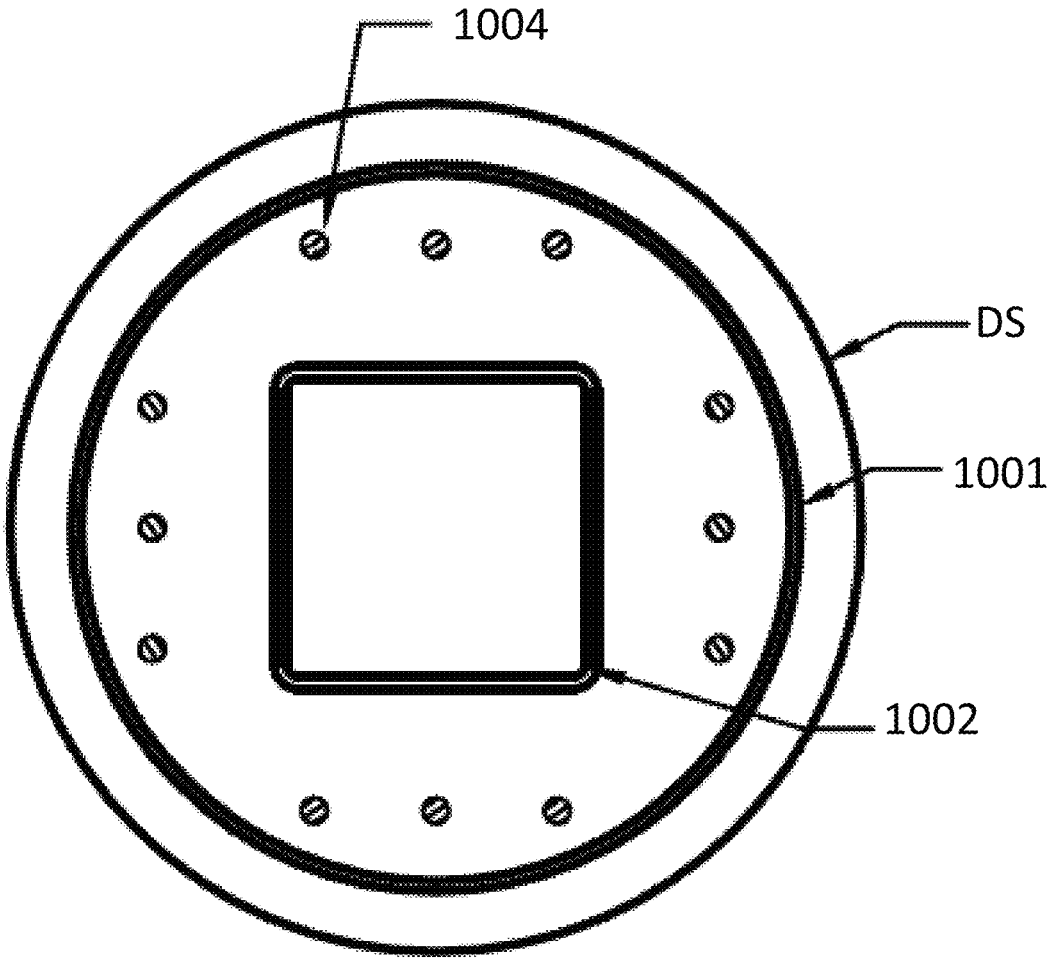
FIG. 4 illustrates a bottom view extending along a length of the hydraulic lift caisson as illustrated in FIG. 1.

FIG. 4 illustrates a top view of the hydraulic lift caisson 1000 according to an example embodiment of the present inventive concept. As illustrated in FIG. 4, the outer steel pipe 1001 includes the steel lifting post 1002 disposed along the center therein and twelve threaded lifting rods 1004 surrounding the steel lifting post 1002, wherein three threaded lifting rods 1004 can be disposed adjacent to each of four sides of the steel lifting post 1002. The outer steel pipe 1001 is configured to be insertable into a drilled shaft DS, which can be pre-drilled down into the ground beneath a building intended to be lifted. Once the drilled shaft DS is formed by drilling into the ground the outer steel pipe 1001, including the steel lifting post 1002 and threaded lifting rods 1004, can be inserted therein until the first (top) end of the outer steel pipe 1001 is positioned under a concrete ring beam CRB disposed beneath a building, as illustrated in FIG. 1, or positioned under a foundation of the building which is to be lifted together with the building. The hydraulic lift caisson 1000 can be positioned under any portion of a building which is sufficiently secure enough to remain intact when being lifted by a plurality of the hydraulic lift systems caissons 1000.

Figure 2:
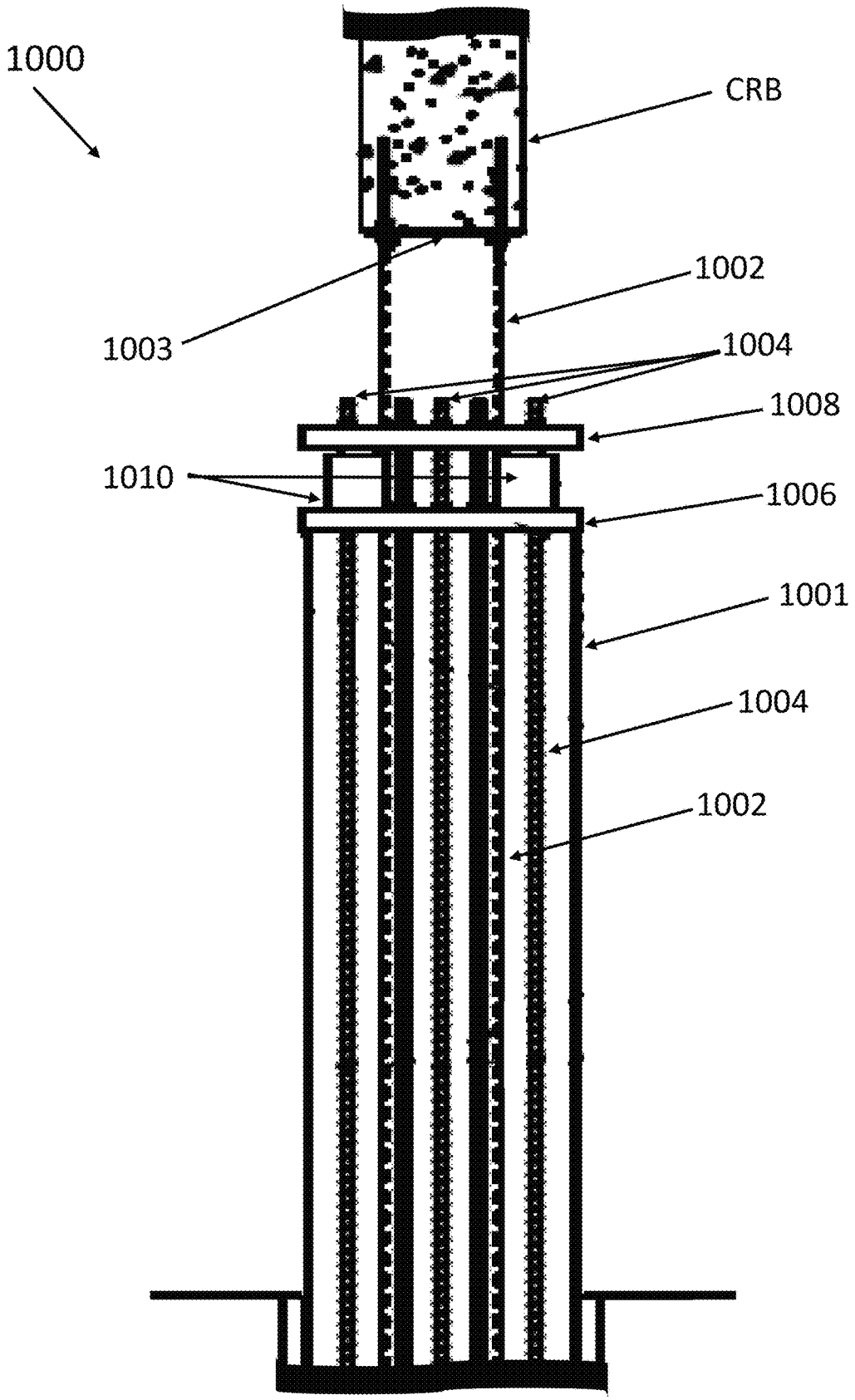
FIG. 2 illustrates an expanded plan view of an upper portion of the hydraulic lift caisson as illustrated in FIG. 1.
Figure 5:
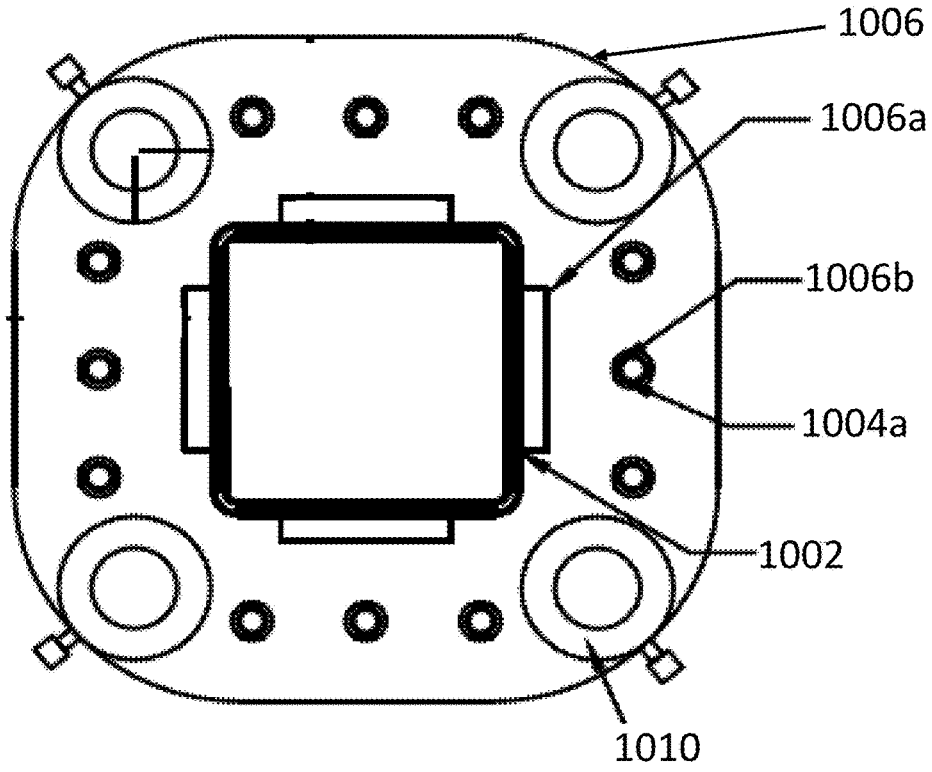
FIG. 5 illustrates a top view of an anchor plate and jack assembly of the hydraulic lift caisson as illustrated in FIG. 1.

FIG. 2 illustrates an expanded plan view of an upper portion of the hydraulic lift caisson 1000 as illustrated in FIG. 1. Referring to FIG. 2, at the first (top) end of the outer steel pipe 1001 can be disposed an anchor (or locking) plate 1006. The anchor plate 1006 can be formed of steel, or any other metal which will perform the intended purposes as described herein without departing from the spirit and scope of the present inventive concept. The anchor plate 1006 can be formed to be 4 inches in thickness and can have a diameter slightly larger than the diameter of the outer steel pipe 1001. Alternatively, the anchor plate 1006 can be formed in a square shape with smoothed or rounded corners, as illustrated in FIG. 5. The anchor plate 1006 is preferably configured to be fixedly secured to the first (top) end of the outer steel pipe 1001. In an example embodiment the anchor plate 1006 can be welded to the first end of the outer steel pipe 1001. The anchor plate 1006 can alternatively be formed as a closed end of the outer steel pipe 1001, acting as a cap of the outer steel pipe 1001. The anchor plate 1006 also can include a centrally located cutout **1006*a* for the steel lift post 1002 to extend therethrough and a plurality of holes 1006*b* symmetrically located to surround the cutout 1006*a* and configured to receive respective ones of the plurality of threaded lifting rods 1004 to extend therethrough. The anchor plate 1006 will be described in more detail below with reference to FIG. 5**.

Referring to FIG. 5, as pointed out above, the anchor plate 1006 can include the centrally located square cutout **1006*a* to receive the steel lifting post 1002 therethrough and the plurality of symmetrically located holes 1006*b* surrounding the cutout 1006***a* to receive first ends of respective threaded lifting rods 1004 therethrough. Once the first ends of the plurality of threaded lifting rods 1004 are freely inserted through the holes 1006*b* an anchor plate locking nut 1004*a* can be threaded onto each of the respective first ends of the threaded lifting rods 1004. The anchor plate locking nuts 1004*a* are provided to rest on the top surface of the anchor plate 1006 after being threaded onto the threaded lifting rods 1004 to "hang" the threaded lifting rods 1004 and steel lifting post 1002 from the anchor plate 1006 and the first (top) end of the outer steel pipe 1001, thus preventing the threaded lifting rods 1004 from dropping down into the outer steel pipe 1001 further than the anchor plate locking nuts 1004*a* will allow.

At each of the four corners of the anchor plate 1006 can be disposed a hydraulic jack 1010, which is described in more detail below. A combined total hydraulic jacking capacity of the four hydraulic jacks is greater than the total weight of the load to be lifted. In an example embodiment of the present inventive concept, each of the hydraulic jacks 1010 can be configured to lift 150 tons of weight. Alternatively, the hydraulic jacks 1010 can be configured to lift an amount of weight that is greater than the building intended to be lifted.

Figure 3:
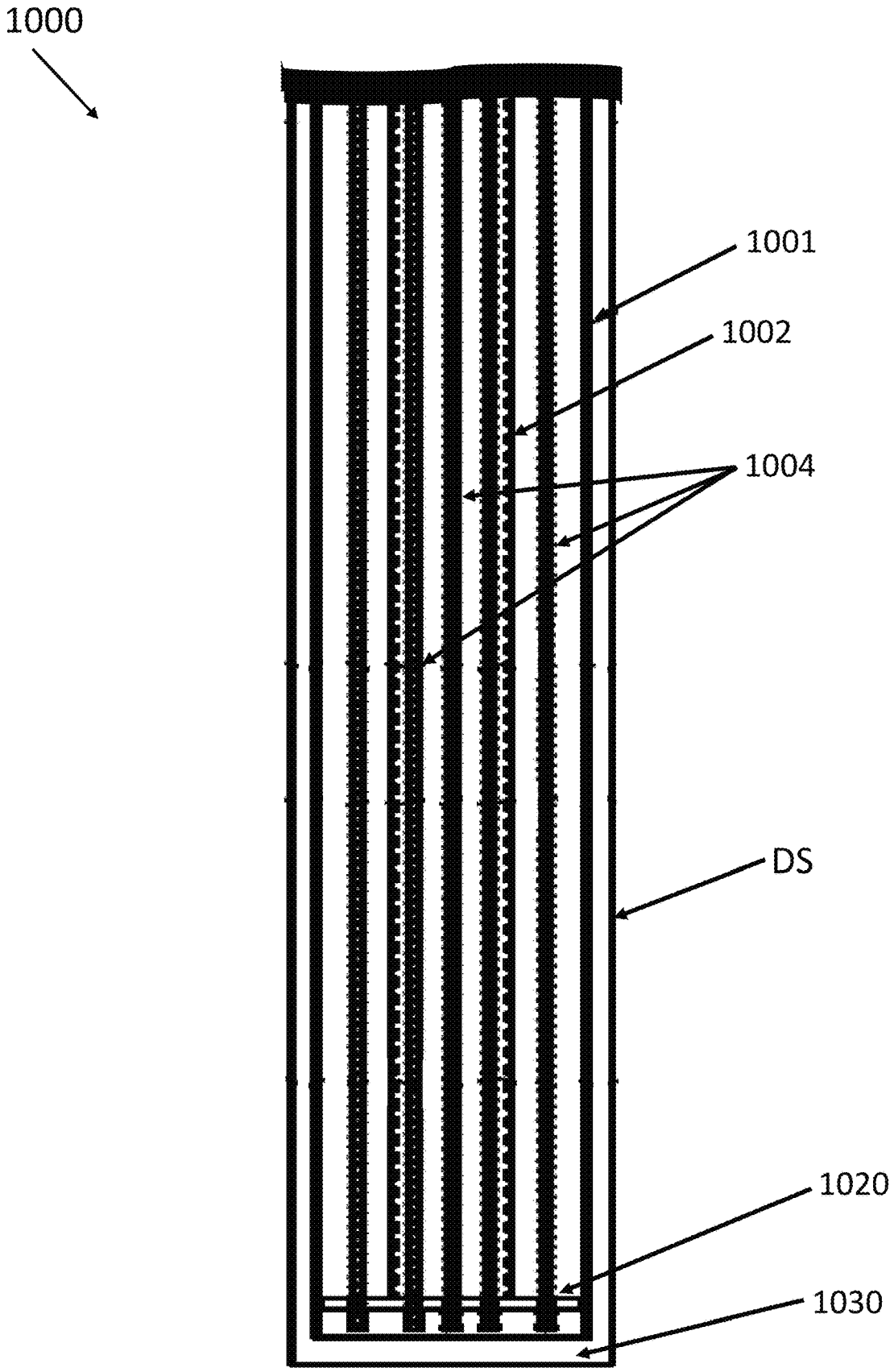
FIG. 3 illustrates an expanded plan view of a bottom portion of the hydraulic lift caisson as illustrated in FIG. 1.

FIG. 3 illustrates a lower section of the hydraulic lift caisson 1000 as illustrated in FIG. 1. Referring to FIG. 3, at a second (bottom) end of the outer steel pipe 1001 can be disposed a base lifting plate 1020. The base lifting plate 1020 is configured to be circular like the outer steel pipe 1002 and to have a diameter equal to or slightly less than the inside diameter of the outer steel pipe 1001 so as to be movable along the length of the inside of the outer steel pipe 1001. The base lifting plate 1020 is also preferably welded to the second (bottom) end of the steel lifting post 1002. The base lifting plate 1020 can include a plurality of drilled holes 1020*a* symmetrically located around the square shaped steel lifting post 1002 such that second (bottom) ends of respective ones of the plurality of threaded lifting rods 1004 can be inserted therethrough. After the second ends of the threaded lifting rods 1004 are inserted through the respective holes 1020*a* in the base lifting plate 1020 a base plate locking nut 1004*c* can be threaded onto respective ones of the second ends of the threaded lifting rods 1004 to secure the second ends of the threaded lifting rods 1004 to the base lifting plate 1020. At the center of the base lifting plate 1020 is fixed the second (bottom) end of the steel lifting post 1002 such that when the threaded lifting rods 1004 are lifted upward along the length of the outer steel pipe 1001 and extend out of the outer steel pipe 1001 the base lifting plate 1020 is also lifted upward along the inner length of the outer steel pipe 1001, which in turn will lift the steel lifting post 1002 upward along the length of the outer steel pipe 1001. At the bottom of the outer steel pipe 1001 can be welded a bottom solid plate 1030 to seal the bottom end of the outer steel pipe 1001.

Figure 6:
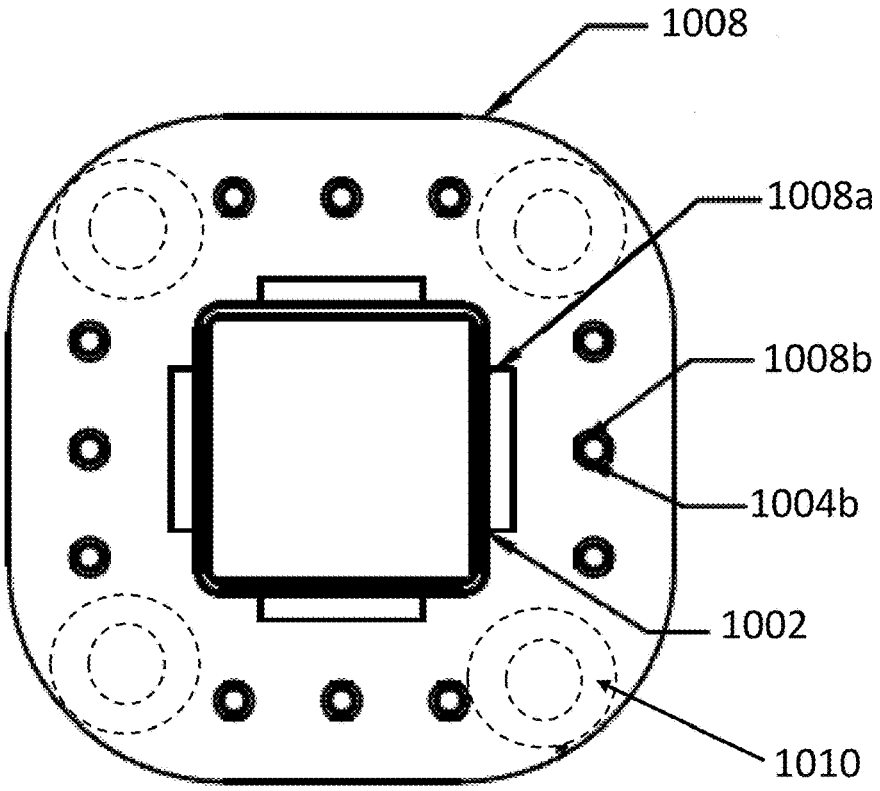
FIG. 6 illustrates a top view of a jack plate of the hydraulic lift caisson as illustrated in FIG. 1.

Referring to FIG. 2 and FIG. 6, a jacking plate 1008 can be disposed directly above the anchor plate 1006 such that the hydraulic jacks 1010 are disposed between the anchor plate 1006 and the jacking plate 1008. The jacking plate 1008 preferably has the same dimensions as the anchor plate 1006 and can include a centrally located cutout 1008*a* to receive the steel lifting post 1002 therethrough similar to the anchor plate 1006. The jacking plate 1008 can also include a plurality of symmetrically located holes 1008*b* surrounding the cutout 1008*a* to receive first ends of the threaded lifting rods 1004 therethrough, similar to the anchor plate 1006.

After the first ends of the threaded lifting rods 1004 are inserted through the respective holes 1006*b* in the jacking plate 1008 a respective jacking plate full load nut 1004*b* can be threaded thereon to force the threaded lifting rods 1004 to be lifted when the jacking plate 1008 is lifted by the hydraulic jacks 1010. With this configuration when the hydraulic jacks 1010, which are resting on the top surface of the anchor plate 1006, lift the jacking plate 1008, the threaded lifting rods 1004 will be lifted upward together with the jacking plate 1008, which will in turn also raise the anchor plate locking nuts 1004*a* upward away from the anchor plate 1006.

The hydraulic jacks 1010 disposed on each anchor plate 1006 are configured to be operated in sync to simultaneously lift the four corners of the jacking plate 1008 such that the jacking plate 1008 remains in a horizontal position while being lifted. The hydraulic jacks 1010 preferably lift the jacking plate 1008 slowly and in approximately four inch increments. After the hydraulic jacks 1010 simultaneously lift the jacking plate 1008 by approximately four inches, which will cause the threaded lifting rods 1004 to be lifted upward by approximately four inches, which will in turn cause the base lifting plate 1020 and steel lifting post 1002 to be lifted together by the same four inches, the anchor plate locking nuts 1004*a* will also be raised off the anchor plate 1006 by the same four inches. Once the anchor plate locking nuts 1004*a* have been raised by four inches away from the anchor plate 1006 the anchor plate locking nuts 1004*a* can be threaded downward until each of the anchor plate locking nuts 1004*a* is once again resting on the top surface of the anchor plate 1006. At this point the steel lifting post 1002 will have been securely lifted upward with respect to the outer steel pipe 1001 and will remain in this position since the anchor plate locking nuts 1004*a* will be securely seated on the anchor plate 1006, thus preventing the threaded lifting rods 1004 from sliding downward due to the weight of the building or other heavy object being lifted. At this point the hydraulic jacks 1010 can be simultaneously retracted back to their starting positions, which will cause the jacking plate 1008 to be lowered to its original position. Once the jacking plate 1008 is lowered back to its original position the jacking plate full load nuts 1004*b* can be threaded downward until they are again resting on the top of the jacking plate 1008. This sequence of operations can be continuously repeated until the building is lifted to the desired height.

As pointed out above, the hydraulic jacks 1010 can continue to lift the jacking plate 1008 upward by approximately four inches at a time, which will in turn lift the steel lifting post 1002 upward by an equal amount. As a result of the hydraulic jacks 1010 continually lifting the jacking plate 1008, the threaded lifting rods 1004, the base lifting plate 1020 and the steel lifting post 1002 simultaneously by approximately four inches, and then threading the anchor plate locking nuts 1004*a* back down onto the surface of the anchor plate 1006, and then retracting the hydraulic jacks 1010 back to their resting position, and then threading the jacking plate full load nuts 1004*b* back down onto the surface of the jacking plate 1008, and then repeating these steps, the building, which will be sitting on a plurality of top lifting plates 1003 welded to the first (top) end of the steel lifting posts 1002, will continue to be lifted away from the ground until the desired height is achieved.

Figure 7:
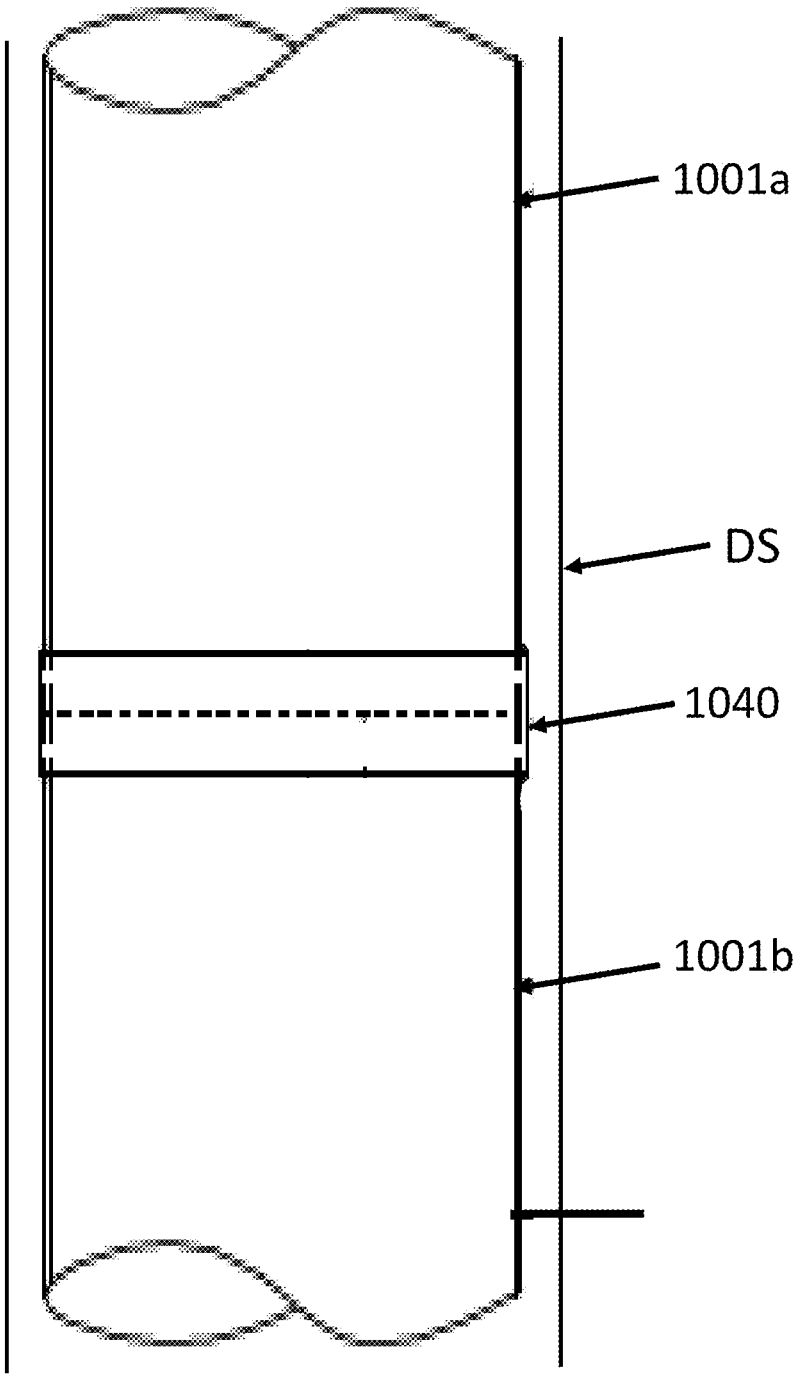
FIG. 7 illustrates two out pipes of a hydraulic lift caisson being connected together, according to an example embodiment of the present inventive concept.

FIG. 7 illustrates a case where two or more outer steel pipes 1001*a* and 1001*b* can be connected together by welding a steel ring 1040 to ends of the outer steel pipes 1001*a* and 1001*b*. Welding two or more outer steel pipes 1001 together can be performed when there is limited headroom below a building and bedrock is a long distance below ground surface. It is to be noted that alternative equivalent methods can be used to securely connect two outer steel pipes 1001 together without departing from the spirit and scope of the overall inventive concept.

Figure 8:
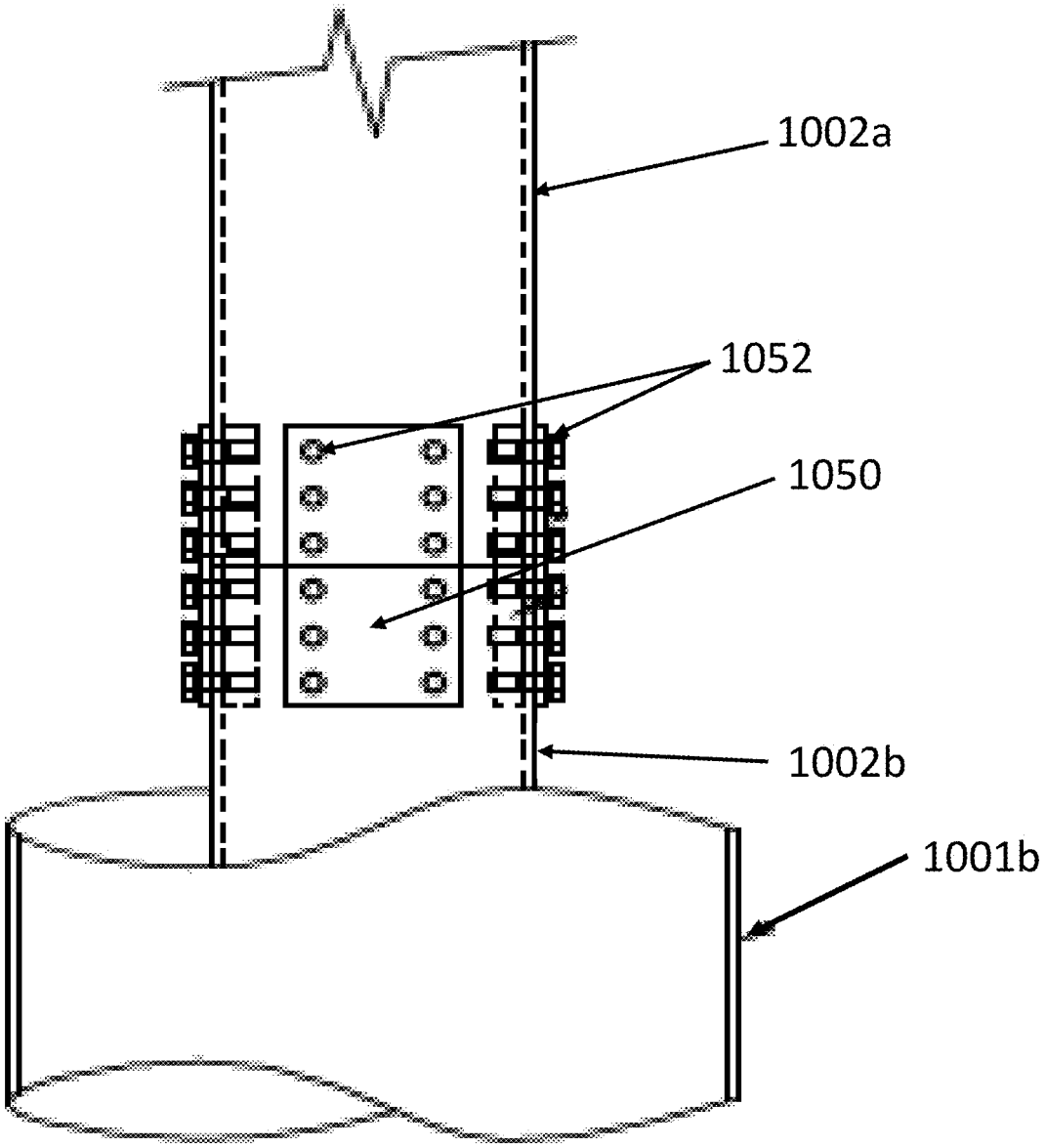
FIG. 8 illustrates two out steel lifting posts of a hydraulic lift caisson being connected together, according to an example embodiment of the present inventive concept.

FIG. 8 illustrates where two or more steel lifting posts 1002*a* and 1002*b* can be connected together when two or more corresponding outer steel pipes 1001 are being used. In this case steel splice plates 1050 can be used to bolt a first steel lifting post 1002*a* to a second steel lifting post 1002*b*. Opposing ends of each side of the first and second steel lifting posts 1002*a* and 1002*b* can have holes drilled therethrough and the steel splice plate 1050 can have a plurality of holes extending along two opposing ends thereof to correspond with the holes drilled through the opposing ends of the first and second steel lifting posts 1002*a* so that each of the four sides of the opposing ends of the steel lifting posts 1002*a* and 1002*b* can be screwed or bolted together using hex cap screws 1052. It is to be noted that alternative equivalent methods can be used to securely connect two steel lifting posts 1002 together without departing from the spirit and scope of the overall inventive concept.

Figure 9:
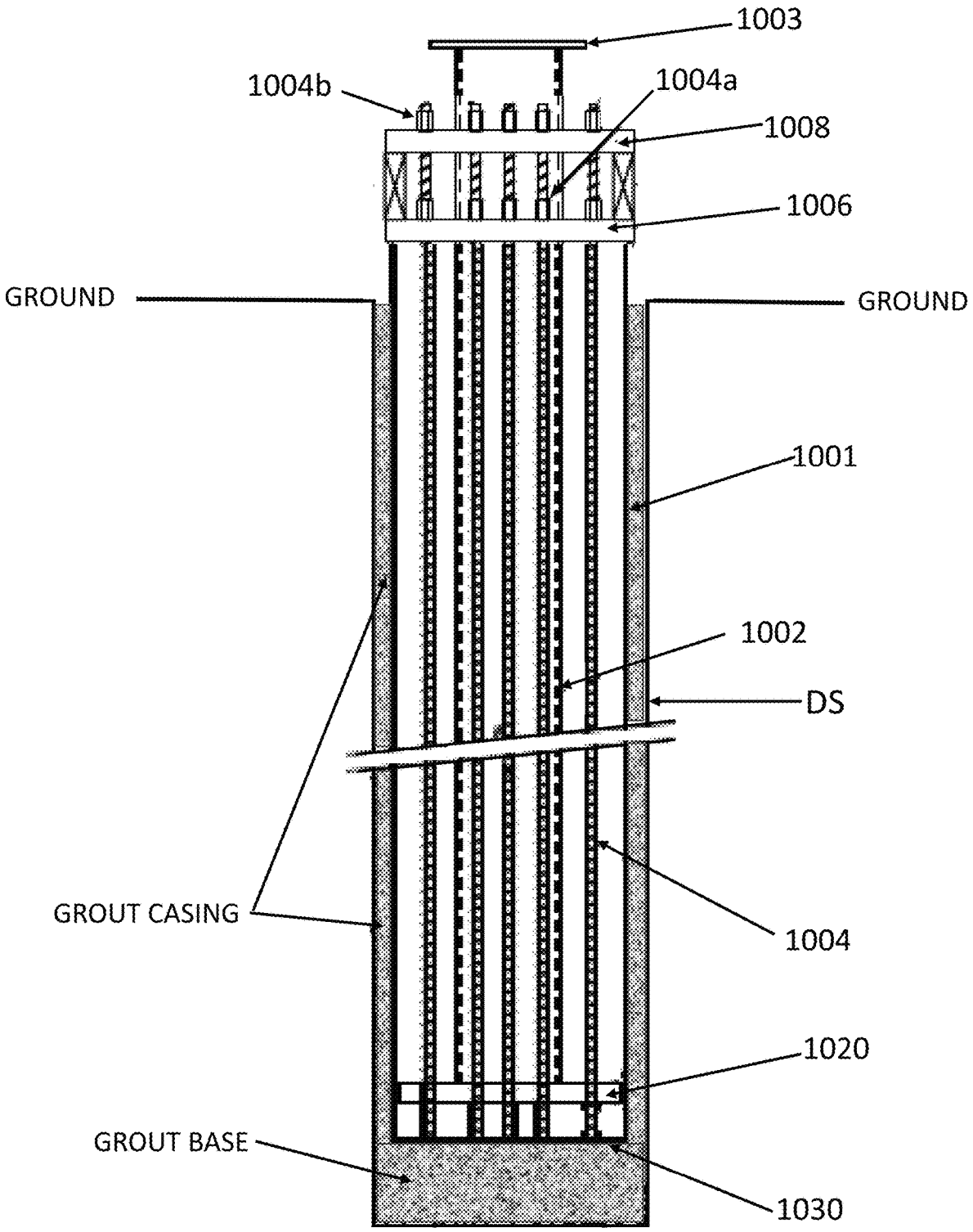
FIG. 9 illustrates the hydraulic lift caisson of FIG. 1 fully installed into the ground.

FIG. 9 illustrates the hydraulic lift caisson 1000 in the position of being fully installed into the ground below the building to be lifted. First, each drill shaft DS should be drilled down to the level such that the top portion of the hydraulic lift caisson 1000 is above the top ground surface or top rock. A grout (or cement) base should then be poured into the drill shaft DS to form a solid base for the hydraulic lift caisson 1000. Then a grout (or cement) casing should be poured around the lower portion of the hydraulic lift caisson 1000 up to approximately the ground level, as illustrated. The grout base and grout casing will provide unique characteristics of achieving very high load lifting capacities for long lift heights. The depth and wall thickness of the outer steel pipe 1001 will be a function of the total carrying capacity required and the soil characteristics by which the hydraulic lift caisson 1000 will be embedded and grouted into the soil/rock. To achieve the desired lifting height of the building to be lifted the length of the hydraulic lift caisson 1000 should be approximately two feet longer than the proposed lift height in order to ensure that there is ample height within the outer steel pipe 1001 for base lifting plate 1020 to rise within the height of the outer steel pipe 1001 and not make contact with the anchor plate 1006 before the final lift height is achieved. Similarly, the square steel lifting post 1002 should be sized to support the total load carrying capacity as well as the "unbraced length" resulting from a projected height of the square steel lifting post 1002, as measured from the top of the anchor plate 1006 to the top of the top plate 1003. In other words, the length of the square steel lifting post 1002 should be equal to the vertical distance from the top of the base lifting plate 1020 to a minimum of one foot above the top of the jacking plate 1008.

Operations of the hydraulic lift caisson 1000 according to an example embodiment of the present inventive concept will now be described in detail below.

Referring back to FIG. 1, a building generally includes an existing masonry foundation wall (EMFW). This EMFW is intended to remain with a building when the building is intended to be lifted. Such buildings generally also include an existing steel framing (ESF) as a bottom surface of the building. Below the existing steel framing ESF is generally disposed a plurality of concrete ring beams CRBs which rest on a concrete slab CS. A plurality of drill shafts DS can be first drilled downward through the concrete slab CS and into the ground below. Then a grout (or cement) base can be poured to create a solid foundation for the hydraulic lift caisson 1000 to securely rest on. Once the hydraulic lift caisson 1000 is dropped down into the drill shaft DS and standing vertically a grout (or cement) casing can be poured around the lower section of the hydraulic lift caisson 1000 to secure the hydraulic lift caisson 1000 in place and in an upright position. The drill shafts DS can be drilled down to a depth such that when the outer steel pipe 1001 is inserted into a respective DS the first (top) end of the outer steel pipe 1001 and the first (top) end of the steel lifting post 1002 can be slid under a respective concrete ring beam CRB. At this point the top lifting plate 1003 will be disposed directly under the respective CRB and the hydraulic lift caisson 1000 is in a vertical position to pour the grout casing. According to an example embodiment the top lifting plate 1003 can be bolted to a bottom surface of the CRB to ensure that the outer steel pipe 1001 and steel lifting post 1002 remain in alignment with the CRB while the grout casing dries around the outer steel pipe 1001.

A hydraulic lift caisson 1000 can be positioned under each of the CRBs used under the intended building to be lifted. Once each of the CRBs has a hydraulic lift caisson 1000 disposed thereunder, the hydraulic jacks 1010 used with each of the plurality of hydraulic lift caissons 1000 can be activated simultaneously to lift their respective jacking plates 1008 in unison by approximately four inches, which will cause the threaded lifting rods 1004 and respective steel lifting posts 1002 to lift the respective CRBs upward, thus lifting the building upward evenly. Each time the four hydraulic jacks 1010 for each of plurality of hydraulic lift caissons 1000 lifts the corresponding jacking plate 1008 up by approximately four inches, the anchor plate locking nuts 1004*a* can be threaded downward along the corresponding threaded lifting rod until the anchor plate locking nuts 1004*a* are again resting on the top of the anchor plate 1006. Then the hydraulic jacks 1010 can be retracted to their original position causing the jacking plates 1008 to be lowered back to their original position. Then the jacking plate full load nuts 1004*b* can be threaded downward to once again rest on the top surface of the jacking plate 1008. This sequence of operations can be continuously repeated until the building being lifted is raised to a desired height for the intended purpose. Moreover, the building being lifted by the plurality of hydraulic lift caissons 1000 will be evenly lifted in one continuous stroke.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A hydraulic lift caisson to lift a building, comprising:

a rigid pipe at least 10 feet in length having first and second ends;

a rigid lifting post at least 10 feet in length disposed within the rigid pipe and including first and second ends;

a base lifting plate having a diameter substantially the same as an inner diameter of the rigid pipe, the base lifting plate being attached to the second end of the rigid lifting post and including a plurality of symmetrical holes therethrough surrounding the rigid lifting post and configured to move along the length of the inner diameter of the rigid pipe;

an anchor plate fixed to the first end of the rigid pipe and including a center cutout to receive the rigid lifting post therethrough and a plurality of symmetrical holes surrounding the cutout;

a jacking plate disposed directly above the anchor plate and including a center cutout to receive the rigid lifting post therethrough and a plurality of symmetrical holes surrounding the cutout;

a plurality of threaded lifting rods extending through respective ones of the holes through the base lifting plate, the anchor plate and the jacking plate, each of the threaded lifting rods including a base plate locking nut threaded onto a bottom end of each of the threaded rods to lock the bottom end of the threaded rods to the base lifting plate, an anchor plate locking nut threaded onto each of the threaded lifting rods directly above the anchor plate to cause the threaded lifting rods to hang from the anchor plate, and a jacking plate full load nut threaded to each of the threaded lifting rods to rest on a top surface of the jacking plate; and a plurality of hydraulic jacks disposed between the anchor plate and the jacking plate to lift the jacking plate away from the anchor plate, thus also lifting the threaded lift rods, base lifting plate and rigid lifting post upward together with the jacking plate.

2. The hydraulic lift caisson according to claim 1, wherein the rigid pipe, the rigid lifting post, the threaded rods, the anchor plate and the jacking plate are formed of steel.

3. The hydraulic lift caisson according to claim 1, wherein the rigid lifting post is square and the plurality of threaded lifting rods are twelve in number, wherein three threaded lifting rods are disposed adjacent to each of the four sides of the rigid lifting post.

4. The hydraulic lift caisson according to claim 1, wherein the anchor plate and the jacking plate are square and the plurality of hydraulic jacks include one hydraulic jack disposed at each corner of the anchor plate and jacking plate.

5. The hydraulic lift caisson according to claim 1, wherein the rigid pipe is thirty-six inches in diameter and has a ½ inch thick wall.

6. The hydraulic lift caisson according to claim 1, wherein the rigid lifting post includes four sixteen inch sides that are each ⅝ inch thick.

7. The hydraulic lift caisson according to claim 1, wherein the anchor plate and the jacking plate are four inches thick.

8. A hydraulic lift caisson to lift large heavy objects, comprising:

a circular rigid pipe having first and second ends;

a rigid lifting post disposed within the rigid circular pipe and including a first end extending out of the first end of the circular rigid pipe and a second end;

a circular base lifting plate having a diameter substantially the same as an inner diameter of the rigid pipe, the base lifting plate being attached to the second end of the rigid lifting post and configured to move along a length of the inner diameter of the rigid circular pipe;

an anchor plate fixed to the first end of the rigid circular pipe and including a center cutout to receive the rigid lifting post therethrough and a plurality of symmetrical holes surrounding the cutout;

a jacking plate disposed directly above the anchor plate and including a center cutout to receive the rigid lifting post therethrough and a plurality of symmetrical holes surrounding the cutout;

a plurality of threaded lifting rods each having a first end extending through respective holes in the anchor plate and jacking plate and having a second end connected to the base lifting plate, each of the threaded lifting rods including an anchor plate locking nut threaded onto the first end thereof to be disposed directly above the anchor plate to cause the threaded lifting rods to hang from the anchor plate and a jacking plate full load nut threaded onto the first end thereof to rest on a top surface of the jacking plate; and at least one hydraulic jack disposed between the anchor plate and the jacking plate to lift the jacking plate away from the anchor plate, thus also lifting the threaded lift rods, the base lifting plate and the rigid lifting post upward together with the jacking plate.

9. The hydraulic lift caisson according to claim 8, wherein the circular rigid pipe and the rigid lifting post are formed in ten feet increments and can be attached to another one of the circular rigid pipes and rigid lifting posts, respectively, to form a single twenty foot circular rigid pipe and a single twenty foot lifting post.

10. The hydraulic lift caisson according to claim 9, wherein the first and second circular rigid pipes are attached to each other by contacting a bottom end of the first circular rigid pipe with a top end of the second circular rigid pipe and welding a steel ring over the two contacting ends.

11. The hydraulic lift caisson according to claim 10, wherein the first and second rigid lifting posts are attached to each other by contacting a bottom end of the first rigid lifting post with a top end of the second rigid lifting post and screwing or bolting at least one shear plate to both the bottom end of the first rigid lifting post and the top end of the second rigid lifting post.

* * * * *